United States Patent [19]

Dokoupil

[11] 4,055,059

[45] Oct. 25, 1977

[54] METHODS AND APPARATUS FOR DEWATERING LEATHER

[76] Inventor: Jiri Dokoupil, Hochstrasse 13, D-6251 Guckingen, Germany

[21] Appl. No.: 716,179

[22] Filed: Aug. 20, 1976

[30] Foreign Application Priority Data

Aug. 30, 1975 Germany ..... 2538703

[51] Int. Cl.[2] ..... C14B 1/08

[52] U.S. Cl. ..... 69/41; 69/21

[58] Field of Search ..... 69/41, 43; 29/113 AD, 29/116 AD; 100/160

[56] References Cited

U.S. PATENT DOCUMENTS

| | | | |
|---|---|---|---|
| 295,948 | 4/1884 | Sawyer | 69/43 |
| 2,344,274 | 3/1944 | Stacom | 100/160 |
| 2,851,869 | 9/1958 | Quoos et al. | 100/160 X |
| 3,638,292 | 1/1972 | Gaghan | 29/113 AD |
| 3,640,105 | 2/1972 | Richter et al. | 69/41 |
| 3,654,781 | 4/1972 | Plechac | 69/41 |

FOREIGN PATENT DOCUMENTS

| | | | |
|---|---|---|---|
| 138,231 | 9/1970 | Czechoslovakia | |
| 141,307 | 5/1971 | Czechoslovakia | |
| 1,582,343 | 9/1969 | France | |
| 6,509,484 | 2/1966 | Netherlands | 29/113 AD |

OTHER PUBLICATIONS p. 49, "Prirucka kozeluha", Praha, 1969, author–Exner.
Russian Authorship No. 346,338, 8/1972.
Czechoslovakia Authorship No. 158,688, July 1975, Repetto.

*Primary Examiner*—Alfred R. Guest
*Attorney, Agent, or Firm*—Werner W. Kleeman

[57] ABSTRACT

A method of, and apparatus for, dewatering leather wherein there is provided at least a first dewatering-pressure zone and to both sides and neighboring such first dewatering-pressure zone two further dewatering-pressure zones producing a lower pressure than the first dewatering-pressure zone. The two further dewatering-pressure zones together with the first dewatering-pressure zone move over the surface of the leather, and the leather, at the region of the pressure zones, is brought into pressure contact, at least at one face or side thereof, with an absorbent element.

10 Claims, 5 Drawing Figures

FIG. 4
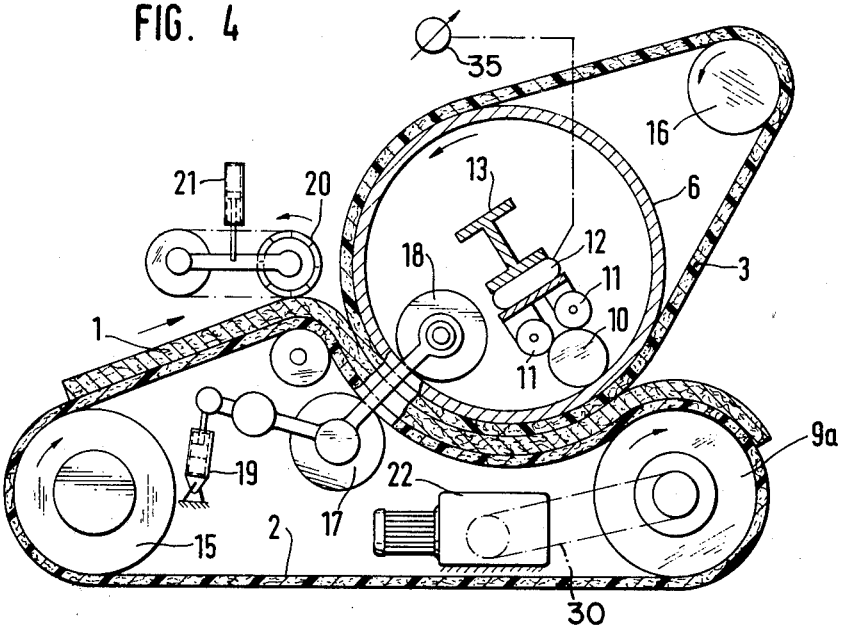
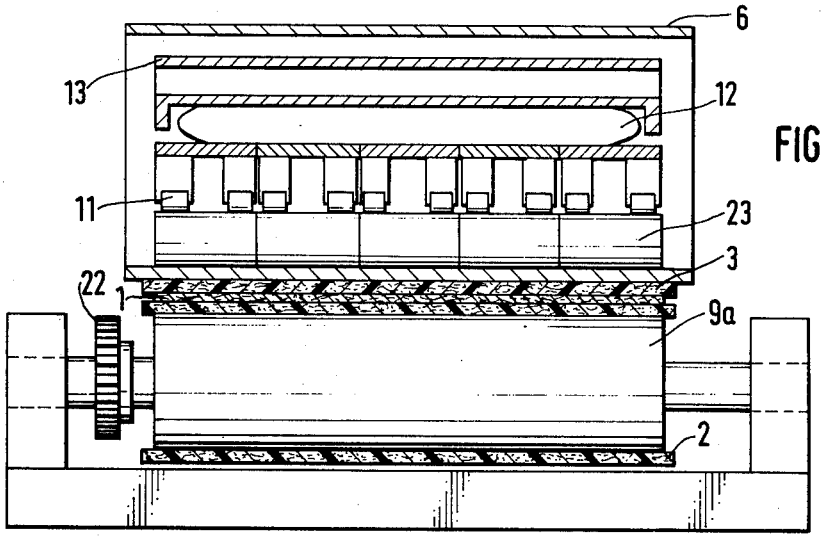
FIG. 5

METHODS AND APPARATUS FOR DEWATERING LEATHER

BACKGROUND OF THE INVENTION

The present invention relates to a new and improved method of dewatering leather wherein there is formed a dewatering-pressure zone acting upon the leather and which moves relative to the leather over its surface. The invention furthermore is concerned with apparatus for dewatering leather wherein the pressure-dewatering zone or region is provided with at least one pair of dewatering-pressure rolls and a pair of transport bands between which there is entrainably guided the leather and through the pair of dewatering-pressure rolls.

During the manufacture of leather the dewatering thereof occurs prior to splitting, prior to folding and also prior to drying. For this purpose there are used methods and apparatuses of the previously mentioned type wherein such are generally designated as "squeeze pressing or compression." A notable problem with this process and the equipment used to perform the same is to avoid any too pronounced formation of folds upon entry of the leather into the pressure zone, especially when applying the high pressures required for rapid dewatering. The formation of folds can be compensated by increasing the roll diameter and maintaining the infeed angle of the leather small. However, then there appear comparatively wide pressure zones, which, in turn, require large forces for producing the requisite dewatering pressure, and thus, are associated with considerable equipment expenditure due to the correspondingly required dimensioning of the structural elements.

SUMMARY OF THE INVENTION

Hence, it is a primary object of the present invention to provide a new and improved method of, and apparatus for, dewatering leather which is not associated with the aforementioned drawbacks and limitations of the prior art porposals.

Another and more specific object of the present invention aims at the provision of a new and improved method of, and apparatus for, dewatering leather which renders possible application of large dewatering pressures with comparatively smaller diameter of the dewatering-pressure rolls and with comparatively lower roll forces, without the formation of undesired folds at the leather.

Now in order to implement these and still further objects of the invention, which will become more readily apparent as the description proceeds, the method aspects of the present invention contemplate providing at least a first dewatering-pressure zone, to each side and neighboring said first dewatering-pressure zone there is provided a respective further dewatering-pressure zone operating at a lower pressure than the first dewatering-pressure zone, the two further dewatering-pressure zones together with the first dewatering-pressure zone move over the surface of leather, and the leather is brought into pressure contact at least at one side or face thereof, at the region of the pressure zones, with an absorbent element.

Not only is the invention concerned with the aforementioned method aspects, but also with a new and improved construction of apparatus for the performance thereof, which comprises a pressure-dewatering zone or region having at least one pair of dewatering-pressure rolls and one pair of transport bands which convey and transport therebetween the leather and move the same through the pair of dewatering-pressure rolls. At least one of the transport bands is constructed to be capable of taking-up or absorbing water, and at least one of the dewatering-pressure rolls is arranged within a hollow roll. The dewatering pressure is applied by means of the jacket or shell of the hollow roll to the leather. Moreover, the jacket or shell of such hollow roll possesses a more pronounced or greater elasticity in radial direction than that of the associated dewatering-pressure roll.

Further, the present invention is based upon the concept of reducing the formation of folds by means of a zone of comparatively low pressure and providing a subsequent narrow zone for an intensive dewatering at high pressure, wherein, owing to the reduced pressure gradient at the infeed region of the high pressure dewatering zone due to the upstream arranged low-pressure zone, there no longer can occur any pronounced formation of folds. An important feature of the apparatus is the arrangement within one another of a thin-walled hollowed roll which is comparatively elastic or yielding in radial direction and a dewatering-pressure roll of comparatively small diameter, the pronounced peripheral curvature of which can form through the hollow roll-flexible shell or jacket a narrow or small width high-pressure zone for rapid dewatering. The comparatively low pressure gradient to both sides of this high pressure zone favors the flowing-off of the squeezed-out water.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 4 schematically illustrates a sectional view, transverse to the roll axes, of essentially an entire squeezing press or apparatus constructed according to the invention, specifically with a pressure-dewatering zone or region constructed according to FIG. 3; and FIG. 5 illustrates in axial sectional view a dewatering-pressure roll of the arrangement of FIG. 3 and composed of partial rolls.

DETAILED DESCRIPTION OF THE PREFERRED EMBODIMENTS

Figure 1:
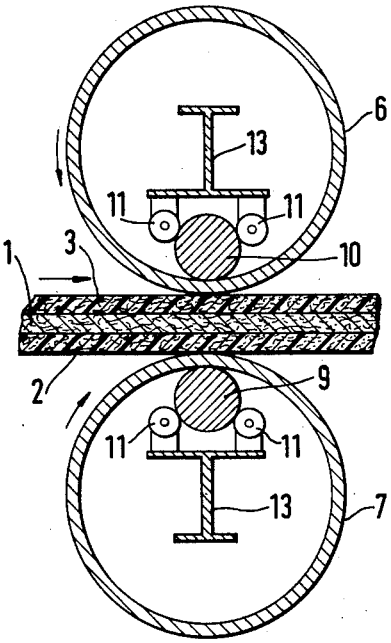
FIG. 1 schematically illustrates a pair of dewatering-pressure rolls and a pair of hollow rolls of a first embodiment of a squeezing press or apparatus according to the invention and shown in radial sectional view.

Describing now the drawings, it is to be understood that only enough of the structure of the leather dewatering apparatus, designed according to the invention, has been shown to enable those skilled in the art to readily understand the basic concepts of the present invention. Turning attention to FIG. 1, it will be seen that to both sides of the leather, which is conveyed in the direction of the not particularly referenced arrow between the transport bands or belts 2 and 3 or equivalent structure, there are arranged two oppositely situated hollow rolls or rollers 6 and 7. Internally of these hollow rolls 6 and 7 there are located the dewatering-pressure rolls or rollers 10 and 9 respectively, forming a pressure-dewatering zone or region A which has been specifically referenced in FIG. 2. These dewatering-pressure rolls 10 and 9 are mounted within the associated hollow roll 6 and 7 at a respective housing-fixed support 13 through the agency of the respective pairs of support rolls 11 which are arranged in offset relationship to one another in the peripheral direction, as shown.

Figure 2:
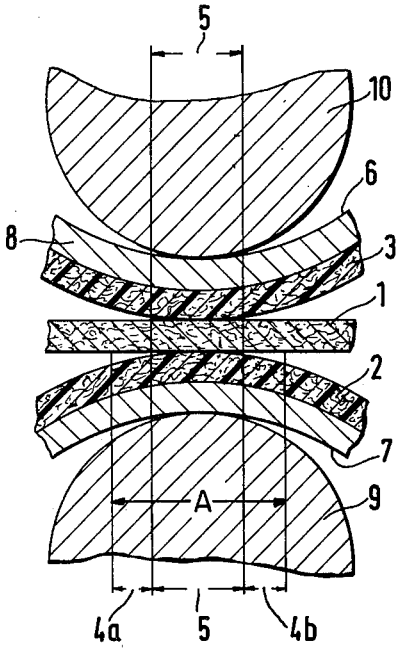
FIG. 2 illustrates on an enlarged scale the pressure-dewatering zone or region of the squeezing press or apparatus according to FIG. 1 but with the transport belts having portions thereof wrapped on the surface of the associated hollow roll.

Within the pressure-dewatering zone A, indicated in FIG. 2, there are formed, by virtue of the pronounced peripheral curvature of the pressure rolls 9, 10 with corresponding radial bending of the jacket or shell 8 of the hollow rolls 6,7 and with compression of the absorbent constructed transport bands or belts 2,3 a first inner high-pressure zone 5 at which there preferably occurs the dewatering action as well as to each side thereof the zones 4*a* and 4*b* of lower pressure by virtue of the lesser peripheral curvature of the hollow rolls 6,7 in contrast to the greater peripheral curvature at the high-pressure zone 5, especially at the nip between the hollow rolls 6,7. This comparatively lesser curvature also requires a pronounced acute-angle infeed wedge (infeed angle) for the leather and in conjunction with the lower pressure gradient or drop which appears in toto, reduces the formation of folds at the leather, in comparison to simple pressure-roll arrangements. The pressure zones, during transport of the leather, move relative thereto over the surface of the leather, so that the processing of the leather can be carried out during continuous throughpass thereof i.e. continuously.

Figure 3:
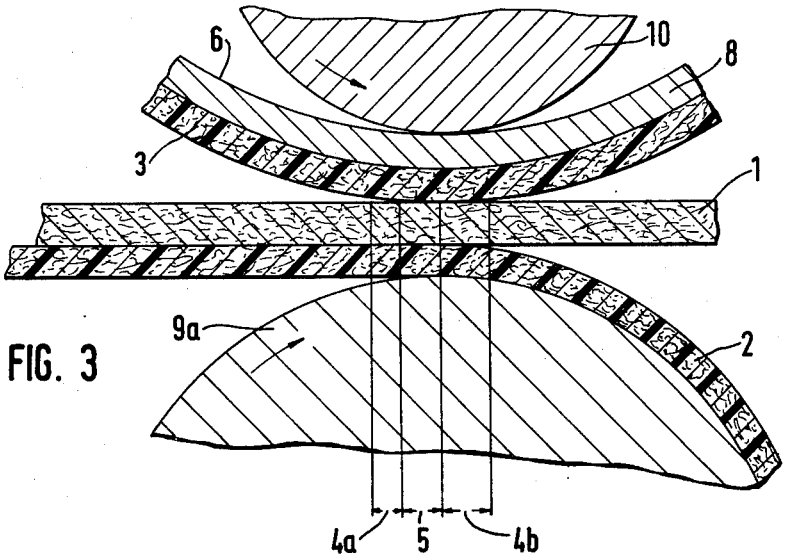
FIG. 3 likewise shows on a comparatively larger scale the pressure-dewatering region of another embodiment of inventive squeezing press or apparatus, similar to the arrangement of FIG. 2, but utilizing only one hollow roll.

FIG. 3 illustrates an appropriate construction of a pressure-dewatering zone for only one hollow roll 6 equipped with the dewatering-pressure roll 10, however with single, rigid, counter-pressure roll 9*a.* As a matter of convenience corresponding elements have been designated with the same reference characters as used for the arrangement of FIG. 2. The construction of the pressure zones 4*a* and 4*b* and 5, in principle, is the same; however for producing the same reduction in the pressure gradient and the same wide low-pressure zones, there is required a more bendable hollow roll jacket or outer surface 8.

FIG. 4 illustrates the entire squeezing press or apparatus equipped with only one hollow-roll arrangement and rigid counter-pressure roll 9*a,* corresponding to the construction of FIG. 3. The last-mentioned roll simultaneously constitutes the deflecting roll for the transport band or belt 2 along with a further deflecting roll 15 and is operatively coupled for instance by a belt or chain 30 or the like with a drive unit or drive means 22. A further deflecting roll 16 is provided for the freely traveling transport band 3, and additionally, at the infeed or inlet region there is provided a further pair of rolls 17, 18 having for instance a pneumatic contact pressure control 19. Moreover, a distributor roll 20 can be lowered by means of a pressure cylinder 21 into its work position and is provided for producing a fold-free infeed of the leather to the pressure arrangement.

Finally, in accordance with the showing of FIG. 5 the dewatering-pressure roll can consist of coaxially arranged partial rolls or rollers 23 which are located behind one another in axial direction, there being provided for each partial roll at least one pair of support rolls with associated, flexible contact pressure device, as discussed above. Also, according to the showing of FIG. 4 there can be provided for all of these partial rolls a common contact pressure device operating for instance with a hose-shaped bellows 12, provided there is insured for an individual contact pressure, which in this case is possible owing to the flexibility or elasticity of the bellows and because of the infeed of a suitable pressurized medium and the pressure control, as schematically indicated by reference character 35. However, the contact pressure can be obtained with other elastic elements formed of rubber or the like.

The transport bands or belts and water absorbent elements which come into contact with the leather in the pressure zone are formed of a suitable absorbent material, for instance textile material, felt of the like. The term "absorbent" as used in the context of this disclosure means an element capable of absorbing or otherwise sucking-up the water squeezed-out of the leather product.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A method of dewatering leather comprising the steps of:

1. feeding the leather containing water along a predetermined path of travel;
2. providing at least a first dewatering-pressure zone along the path of travel for the leather;
3. providing two further dewatering-pressure zones, one to each side and neighboring the first dewatering-pressure zone, said two further dewatering-pressure zones producing a pressure which is less than the pressure generated at the first dewatering-pressure zone;
4. said two further dewatering-pressure zones moving together with the first dewatering-pressure zone over the surface of the leather; and
5. bringing into pressure contact with the leather at least at one side thereof at the region of the pressure zones an absorbent element for removing the squeezed-out water.

2. An apparatus for dewatering leather, comprising at least one pair of dewatering-pressure rolls defining a dewatering zone, a pair of transport bands conveying the leather therebetween in a predetermined direction of travel and between the dewatering-pressure roll pair, at least one of the transport bands is structured for taking-up water, a hollow roll within which there is arranged at least one of the dewatering-pressure rolls, said hollow roll having a flexible shell, said hollow roll cooperating with the other of said dewatering-pressure rolls to define therebetween a roll nip through which passes the leather to be dewatered, the dewatering pressure being transmitted via the flexible shell of the hollow roll to the leather, said flexible shell of the hollow roll possessing a greater elasticity in radial direction in comparison to the elasticity in radial direction of said one dewatering-pressure roll arranged therein.

3. The apparatus as defined in claim 2, wherein the dewatering-pressure rolls comprise two oppositely situated rolls, one such dewatering-pressure roll located to each side of the leather, one said elastic hollow with a flexible shell roll being provided for each said dewatering-pressure roll, one such dewatering-pressure roll being arranged within each associated one of said hollow rolls.

4. The apparatus as defined in claim 2, further including means for mounting said at least one dewatering-pressure roll within the hollow roll, said mounting means comprising a housing-fixed support and support rolls carried at the housing-fixed support and bearing with their peripheral surface at the peripheral surface of the associated dewatering-pressure roll.

5. The apparatus as defined in claim 4, wherein said support rolls comprise at least one pair of said support rolls which are offset with respect to one another in the peripheral direction of the associated dewatering-pressure roll.

6. The apparatus as defined in claim 5, wherein at least one of said dewatering-pressure rolls comprises partial rolls coaxially arranged and disposed behind one another in axial direction, and at least one pair of said support rolls and an associated flexible contact pressure mechanism are provided for each partial roll.

7. The apparatus as defined in claim 4, further including pressure means acting upon the support rolls for producing and adjusting the contact pressure of the dewateringpressure rolls, said pressure means including a pressure bellows extending at least partially over the working width of the rolls.

8. The apparatus as defined in claim 2, wherein said flexible shell of said hollow roll cooperates with said dewatering-pressure rolls such that said hollow shell bends at the region of said roll nip relative to said one dewatering-pressure roll in a manner such that the greatest curvature of said hollow shell is at the region of said roll nip and said hollow shell possesses a lesser curvature upstream and downstream of said roll nip with respect to said direction of travel of the leather.

9. The apparatus as defined in claim 8, wherein said hollow shell is non-constrained at its ends to allow for said bending thereof.

10. An apparatus for dewatering leather, comprising at least one pair of dewatering-pressure rolls defining a dewatering zone, transport means for conveying the leather between the dewatering-pressure roll pair and for absorbing water expressed from the leather, a hollow roll within which there is arranged at least one of the dewatering-pressure rolls, said hollow roll cooperating with the other of said dewatering-pressure rolls to form therebetween a roll nip through which passes the leather to be dewatered, said hollow roll having a flexible jacket, the dewatering pressure being transmitted via the flexible jacket of the hollow roll to the leather, said flexible jacket of the hollow roll possessing a greater elasticity in radial direction in comparison to the elasticity in radial direction of said one dewatering-pressure roll arranged therein, said flexible jacket cooperating with said pair of dewatering-pressure rolls to form at said dewatering zone an increased pressure zone at the region of said roll nip and to each side thereof a respective zone of reduced pressure relative to said increased pressure zone, one of said reduced pressure zones providing an infeed region for the leather, whereby there is provided relatively wrinkle free infeed of the leather from said infeed zone of reduced pressure to said roll nip and high squeezing-dewatering action at the increased pressure zone.

* * * * *